US006029025A

United States Patent [19]

Sakakibara et al.

[11] Patent Number: 6,029,025

[45] Date of Patent: Feb. 22, 2000

[54] IMAGE FORMING APPARATUS WITH VARIABLE EFFICIENCY CLEANING MECHANISM

[75] Inventors: Hiroshi Sakakibara, Anjyo; Hiroshi Fukao; Mineyuki Sako, both of Toyokawa; Kuniya Matsuura, Toyohashi; Shingo Hirota, Kobe, all of Japan

[73] Assignee: Minolta Co., Ltd., Osaka, Japan

[21] Appl. No.: 09/036,795

[22] Filed: Mar. 9, 1998

[30] Foreign Application Priority Data

Mar. 12, 1997 [JP] Japan ..... 9-057928
Mar. 14, 1997 [JP] Japan ..... 9-059697

[51] Int. Cl.[7] ..... G03G 21/00

[52] U.S. Cl. ..... 399/71; 399/299

[58] Field of Search ..... 399/71, 138, 343, 399/345, 299

[56] References Cited

U.S. PATENT DOCUMENTS 5,657,114 8/1997 Kitajima et al. ..... 399/71
5,765,082 6/1998 Numazu et al. ..... 399/299

FOREIGN PATENT DOCUMENTS 58-184978 10/1983 Japan .
60-235186 11/1985 Japan .
5-265355 10/1993 Japan .
06195010A 7/1994 Japan .
7-319353 12/1995 Japan .

*Primary Examiner*—Joan Pendegrass
*Attorney, Agent, or Firm*—Burns, Doane, Swecker & Mathis, LLP

[57] ABSTRACT

An image forming apparatus, such as a printer or photocopier, has a cleaning device for cleaning an image carrier. The efficiency with which the cleaning device cleans the image carrier is varied in dependence upon the image forming conditions, to thereby reduce wear on both the cleaning device and the image carrier. In one embodiment, cleaning efficiency is varied by changing the contact pressure between a cleaning blade and the image carrier. In a color apparatus with multiple image-forming units, the image forming conditions relate to whether the image to be formed is monochrome, composite color or simul-color.

38 Claims, 4 Drawing Sheets

IMAGE FORMING APPARATUS WITH VARIABLE EFFICIENCY CLEANING MECHANISM

This application claims priority under 35 U.S.C. §§119 and/or 365 to 09-057928 & 09-05697 filed in Japan on Mar. 12, 1997 & Mar. 14, 1997; the entire content of which is hereby incorporated by reference.

FIELD OF THE INVENTION

The present invention pertains to an image forming apparatus such as a copying machine, facsimile machine or printer, and more particularly to an image forming apparatus having an improved cleaning means that cleans an image carrier that transfers a developed image to a transfer medium.

BACKGROUND OF THE INVENTION

Conventional image forming apparatuses include those in which a cleaning means is constantly cleaning the image carrier and those that do not have a cleaning means. In a conventional image forming apparatus in which a cleaning means is constantly cleaning the image carrier, a problem arises in that the image carrier and the cleaning means have short useful lives. In addition, in a conventional image forming apparatus that does not have a cleaning means, a problem occurs in that some matter may remain affixed to the image carrier, preventing a satisfactory image from being subsequently obtained.

One object of the present invention, therefore, is to provide an image forming apparatus in which a satisfactory image can be obtained and in which the image carrier and the cleaning means have long useful lives.

The foregoing problem is particularly noticeable in a tandem-type image forming apparatus, which forms a color image on a single sheet of paper by sequentially forming and combining color images of different colors by means of multiple image forming units. In addition to a color mode in which color images are formed, this type of image forming apparatus has an image creation condition in which only a portion of the image forming units are used, e.g., a monochrome mode in which images of a selected single color only are formed. The image forming units are naturally driven in unison during the color mode. They are also driven in unison during a monochrome mode in which some of the image forming units are not used, so that mutual synchronization is maintained.

When a conventional color image forming apparatus is not operating in the color mode, the cleaner blades of the image forming units that are not carrying out image creation sometimes become curled and cause damage to the photoreceptors. Problems resulting from this damage include the occurrence of image noise and excessive wear to the photoreceptive layers of the photoreceptors, resulting in a reduction in the useful lives of the photoreceptors. This is due to the fact that, during image creation in the monochrome mode, the cleaner blades continue to clean the image carriers of the image forming units that are not being used even when there is no remaining matter on them. While in principle it may be possible to move the cleaning blades out of contact with those image carriers whose image forming units are not being used, in practice this is not feasible since it causes a significant difference in the torques on the respective image carriers, which could result in a loss of synchronization between them and therefore poor image quality. Consequently, it is preferable to maintain the cleaning blades in constant contact with the image carriers. However, this constant contact results in scraping the surfaces of the photoreceptors and reducing their useful lives, as well as making the photoreceptor surfaces extremely smooth. This causes the photoreceptors to adhere to the cleaner blades, resulting in increased frictional resistance and curling of the cleaner blades. The problems of wear and damage to the image carriers, image noise and short useful lives remain even if cleaning rollers, cleaning brushes, magnetic brush rollers, etc. are used for the cleaning means instead of cleaner blades.

It is another object of the present invention, therefore, to provide a color image forming apparatus that minimizes the effects of wasteful cleaning, prevents the occurrence of image noise and prolongs the useful lives of the photoreceptors.

SUMMARY OF THE INVENTION

In order to achieve the foregoing objects, the image forming apparatus of the present invention has an image carrier that carries an image formed on its surface and transfers it to a transfer medium to form an image under selectable image creation conditions. A cleaning means cleans the surface of the image carrier after the image transfer, and an alternating means changes the cleaning efficiency of the cleaning means, wherein the alternating means is operated in response to the selected image creation conditions. In one embodiment of the invention, cleaning efficiency is determined by the contact pressure between a cleaning blade and the image carrier.

By operating the alternating means in response to the image creation conditions at the time of image creation, the cleaning efficiency of the cleaning means which cleans the surface of the image carrier after transfer of the image to the transfer medium is changed so that it is appropriate to those image creation conditions. Therefore, while selected image creation conditions such as image quality may be obtained by means of a cleaning efficiency that is appropriate to those image creation conditions, the burden of cleaning may be reduced to the extent of the reduction in cleaning efficiency corresponding to the selected image creation conditions.

Therefore, using the present invention, the selected image creation conditions such as image quality may be satisfied. In addition, the useful lives of the image carrier and cleaning means may be extended to the extent that the burden imposed by cleaning is reduced in response to the image creation conditions.

In a color image forming apparatus which has multiple image forming units, as well as image creation conditions in which the image forming units are selected in various combinations, each of the image forming units comprises an image carrier, a charging means that charges the image carrier, an exposure means that forms a latent image on the charged image carrier, a developing means that develops the latent image on the image carrier into a toner image, a transfer means that transfers to a transfer medium the toner image formed on the image carrier, and a cleaning means that cleans off any remaining matter on the image carrier after the transfer is performed. A cleaning parameter changing means changes a cleaning parameter governing the cleaning means, such as cleaning blade contact pressure. The cleaning parameter changing means of the image forming units that are not used for image creation are operated in response to selected image operating conditions.

With this arrangement, each image forming unit can form an image of the color that it represents onto a sheet of paper by means of the operations of it components, and by using image forming units that correspond to the image creation condition selected. These image forming units are combined in a certain manner, so that a color image, a mono-color image, or a so-called simul-color image, in which a required number of colors are used for different regions of the sheet, may be formed. During image creation in response to these various image creation conditions, the cleaning parameter changing means that accompany the image forming units that are not used for image creation are operated on the basis of the selected image creation condition. The cleaning parameter may be changed between the case when the image forming unit is used and that when the image forming unit is not used, such that the cleaning parameter for the latter is less stringent than that for the former in order to prevent the surface of the image carrier from being scraped away.

If the ratio of the contact pressure between the situations when the image forming unit is operated and when it is not operated (operation/non-operation), which comprises one cleaning parameter, is between 1.2 and 6, no gap occurs that causes scattered toner particles to exist between the cleaning means and the image carrier, and no torque change that causes errors in the synchronization of the image carriers is caused by the change in the contact pressure of the cleaning means against the image carrier. Consequently, the surface of the image carrier is adequately prevented from being scraped away by wasteful cleaning.

Since the cleaning parameters for the image forming units that are not used for image creation are made less strict than those used during image creation, to prevent the photoreceptive layers of the photoreceptors of the image units that are not being used from being scraped away by wasteful cleaning, the occurrence of image noise may be prevented. Furthermore, internal contamination due to scattered toner particles, erroneously overlapped color images, and scraping of and damage to the surfaces of the image carriers may be prevented, such that the useful lives of the photoreceptors may be prolonged.

DETAILED DESCRIPTION

One representative embodiment of the present invention will be explained in detail below, with reference to FIGS. 1 through 4. For the image forming apparatus of this embodiment, an example of an image forming apparatus that forms an image on a transfer medium by means of the electrophotographic process is shown, which is used for image creation in such devices as a copying machine, printer or facsimile machine. The image forming apparatus of this embodiment has a rotating drum-type photoreceptor as an image carrier, which carries an image formed by means of the electrophotographic process. However, the embodiment of the image carrier is not limited to this type of photoreceptor, and a belt-type photoreceptor may be used instead. In addition, if the image carrier carries a formed image and can transfer that image to a transfer medium which faces it, any image carrier material or configuration, image creation method or transfer method may be used.

Figure 1:
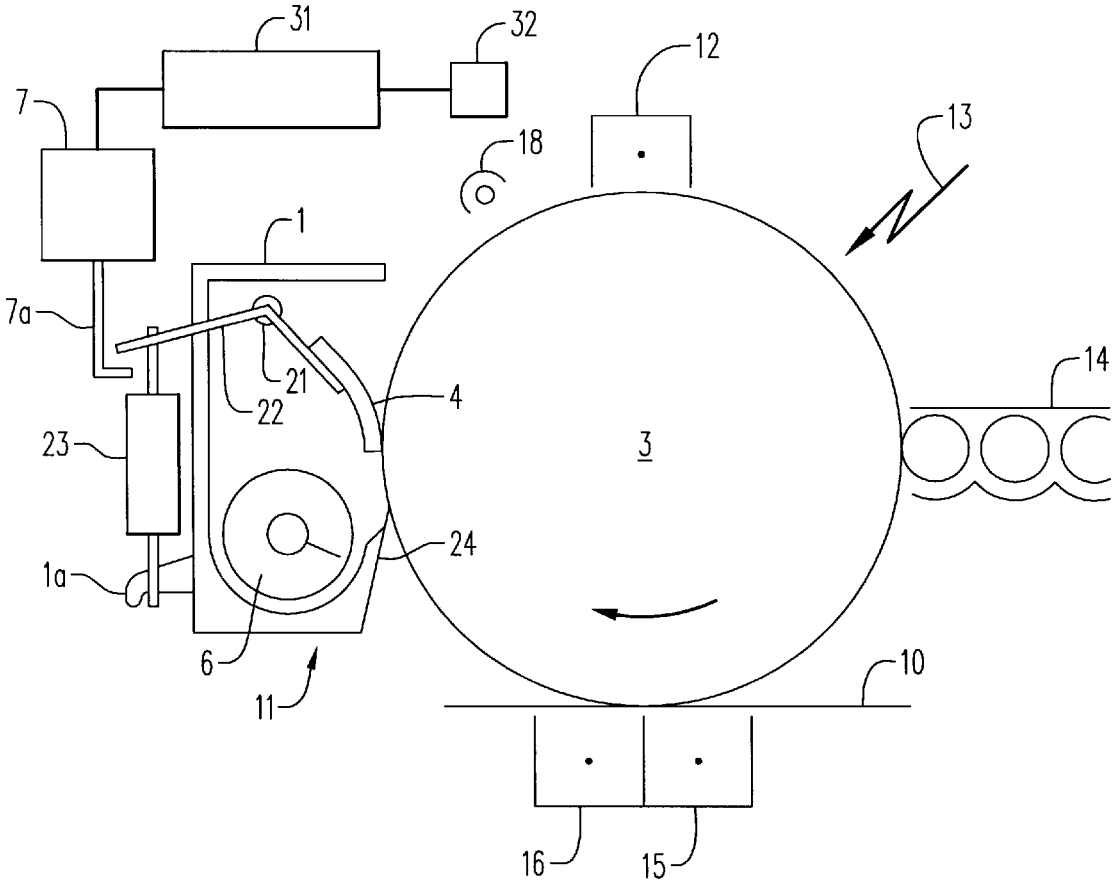
FIG. 1 shows the general construction of an image forming apparatus, showing a representative embodiment of the present invention, when the cleaning efficiency is high.

Referring to FIG. 1, the surface of photoreceptor 3 is uniformly charged by means of an appropriate charging means 12 comprising a corona charger, charging roller, charging brush, etc. This charged surface receives either image exposure light 13 using the analog method, in which an image is projected onto the charged surface, or image exposure light 13 using the digital method, in which a laser beam that is modulated by means of an image signal is irradiated onto the surface, and as a result a latent image is formed. This latent image is developed into a toner image by means of developer unit 14. This toner image is electrostatically transferred onto transfer medium 10, which is conveyed in synchronization with the movement of the surface of photoreceptor 3 and comes into contact with that surface, by means of an appropriate transfer means 15 comprising a transfer charger, transfer roller, transfer brush, etc. After the transfer, transfer medium 10 is separated from photoreceptor 3 by means of separating charger 16. It is then sent to a fuser, not shown in the drawings, where it undergoes fusing through the application of heat and pressure. After it undergoes fusing, it is ejected outside the image forming apparatus, for example. For transfer medium 10, in addition to paper, various other materials such as a resin sheet for use with an overhead projection device may be used.

After transfer, cleaning device 11 cleans the surface of photoreceptor 3 and removes any remaining foreign matter such as toner or paper particles. If foreign matter were to remain on the surface of photoreceptor 3 after transfer, the image quality for subsequent image creation would be affected, such as due to the occurrence of background fog. Therefore, where a high-quality image is required, a high degree of cleaning efficiency is necessary. However, in this case, as the cleaning burden is increased, the useful lives of photoreceptor 3 and cleaning device 11 are shortened. Consequently, the cleaning efficiency is reduced as much as possible while maintaining the required image quality. When this is done, the required image quality can be obtained even while the useful lives of photoreceptor 3 and cleaning device 11 are extended. After the surface of photoreceptor 3 is cleaned, any remaining charge on it is removed via irradiation from eraser 18. As a result of this irradiation, any remaining charge is prevented from affecting the subsequent image creation.

Cleaning device 11 of this embodiment uses the blade method in which cleaner blade 4 cleans the surface of photoreceptor 3 by coming into pressure contact with it. Cleaner blade 4 is made of an elastic material such as rubber or synthetic resin, or a metal plate where necessary. However, the blade material is not limited to these examples. In addition, any appropriate cleaning means may be used for the method to be used by cleaning device 11, including the fur brush method, the magnetic brush method, the web method and the roller method. Among these various methods, those of the same type or of different types may be combined.

Figure 2:
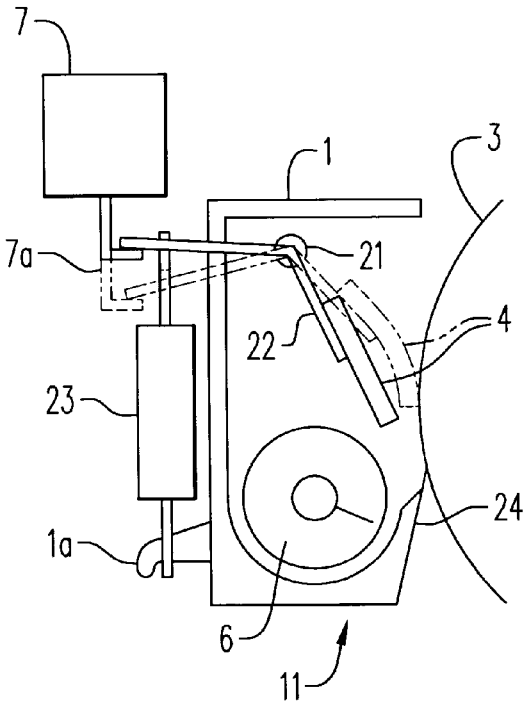
FIG. 2 is a cross-sectional view showing a situation in which the cleaning efficiency of the cleaning device shown in FIG. 1 is reduced.

Cleaning device 11 of this embodiment is equipped with casing 1 as shown in FIG. 1. Casing 1 has shaft 21 in the upper area of its interior. Shaft 21 supports blade holder 22 approximately at its center. Blade holder 22 has cleaner blade 4 located at its tip facing photoreceptor 3. Cleaner blade 4 is affixed to blade holder 22 such that the tip of cleaner blade 4 faces in a direction opposite the direction of rotation of photoreceptor 3 that is indicated by an arrow. Spring 23 is located between the other tip of blade holder 22 and casing 1. Through the action of this spring, the tip of cleaner blade 4 comes into pressure contact with the surface of photoreceptor 3. Consequently, cleaner blade 4 scrapes off, into the interior of casing 1, any foreign matter remaining on the surface of photoreceptor 3 that rotates in the direction of the arrow in the drawing when image creation occurs. Sealing piece 24 made of a material such as PET is located at the lower part of casing 1. Sealing piece 24 is located so as to come into sliding contact with the surface of photoreceptor 3, and guides into the interior of casing 1 the remaining foreign matter that was scraped off by cleaner blade 4. Conveying member 6 is located in the lower part of the interior of casing 1. Conveying member 6 can be a rotatable spiral blade, for example. Through the rotation of conveying member 6, the remaining foreign matter that was guided toward the bottom of casing 1 is sent to an expelled toner container that is located outside cleaning device 11 and is not shown in the drawings.

Where cleaning device 11 uses the blade method described above, it is preferable for a change in cleaning efficiency to be carried out by selecting (i) the degree of pressure to be applied to photoreceptor 3 by cleaner blade 4 and (ii) whether or not cleaner blade 4 is to make contact with photoreceptor 3. In this embodiment, switching of the amount of applied pressure is performed by means of solenoid 7. Where it is desired to increase the cleaning efficiency, actuator 7*a* of solenoid 7 moves downward, as shown in FIG. 1. When this occurs, blade holder 22 becomes free of actuator 7*a*. As a result, cleaner blade 4 comes into pressure contact with the surface of photoreceptor 3 with the maximum degree of pressure set by means of spring 23.

Where it is desired to reduce the cleaning efficiency, actuator 7*a* of solenoid 7 is moved upward, as shown by the two-dot chain line in FIG. 2, so that blade holder 22 is pulled up against the resistance of spring 23. When this occurs, the amount of contact pressure is smaller than the normal degree of pressure obtained in the situation shown in FIG. 1, corresponding to high image quality. Where the cleaning efficiency is to be reduced, either the situation shown by the two-dot chain line in FIG. 2, in which cleaner blade 4 exerts only light contact pressure on the surface of photoreceptor 3, or the situation shown by the solid line in FIG. 2, in which cleaner blade 4 does not make contact with the surface of photoreceptor 3, is acceptable.

In the example described above, it is sufficient if solenoid 7 operates in a two-step fashion. However, it is also possible to change the cleaning efficiency by cycling among three steps, i.e., the pressure contact situation shown in FIG. 1, the situation shown by the two-dot chain line in FIG. 2, and the situation shown by the solid line in FIG. 2. In this case, a drive source that operates in three steps is required. As a drive source of this type, various types of public domain linear-movement mechanisms, including a solenoid, rotating mechanisms, or combinations of any of these mechanisms, and an appropriate drive transmission means such as a cam, may be used, so that various types of cleaning members such as cleaner blade 4 may be caused to come into contact with the surface of photoreceptor 3, the degree of pressure may be adjusted, and termination of their contact may be obtained. The cleaning member may be caused to come into contact with and separate from the image carrier via the rotation, linear movement or other movement of the cleaning member or of the entire cleaning device or an appropriate part thereof. As discussed below in connection with the alternate embodiment of FIG. 6, spring support member 1*a* that supports spring 23 and which is located on casing 1 can be moved such that the spring force of spring 23 varies over a range of different settings.

FIG. 1 shows a setting at which the cleaning efficiency is such that virtually 100% of the developer is scraped off. The solid line in FIG. 2 shows a situation where the cleaning efficiency is at its lowest setting, i.e., a setting at which cleaner blade 4 does not make contact with the photoreceptor, and none of the developer whatsoever is cleaned off. The two-dot chain line in FIG. 2 shows a setting at which approximately half of the developer is scraped off. However, it is not necessary for the high and low cleaning efficiency levels to be a combination of 100% and 0% or 100% and 50%. For example, it is acceptable if the high and low settings are determined appropriately depending on the process, such that more than 50% of the developer may be removed at the high setting and less than 50% may be removed at the low setting.

Alternatively, where the fur brush method is used, for example, the cleaning efficiency may be changed by changing the number of rotations, the conditions of the applied bias, or the degree of pressure with which the brush is pressed against the image carrier.

The image creation conditions that determine the cleaning efficiency during image creation include whether high quality images are necessary, whether the minimum image quality may be maintained, whether the useful lives of the image carrier and cleaning member need to be extended and whether it is necessary to polish the surface of the image carrier. For example, in the case of test or draft printing in which the quality of the output image is not an issue, the cleaning efficiency can be reduced so that the wear on the image carrier and cleaning member may be reduced in order to extend their useful lives and to make replacement unnecessary for a long time. Conversely, where higher image quality is desired, as in the case of important documents or graphics, or when the image quality has deteriorated because image creation has been continued using a low cleaning efficiency or because transfer was not properly carried out due to paper feeding trouble, etc., or when foreign matter, such as developer ingredients or paper particles, is adhering or is likely to adhere to the surface of the image carrier, the cleaning efficiency is increased in order to prevent a reduction in image quality.

In this embodiment, for the control described above, the operation of solenoid 7 is controlled by control means 31 such that the solenoid is driven in a manner corresponding to the selected image creation conditions. To implement the control means 31, the functions of a microcomputer which is used for the operational control of the image forming apparatus may be used. Alternatively, a dedicated control circuit or control device may be used for control means 31, or a control circuit or control device for other necessary control processes may be shared. Control means 31 controls the operation of solenoid 7 in response to image creation condition selection signals provided by input unit 32, such as an operator's panel, that accompanies the control means. However, when the cleaning efficiency is changed based on an image creation condition that can be automatically detected, such as the frequency of use, the period of continuous use at a low cleaning efficiency, the dirtiness of the surface of photoreceptor 3 after transfer, or the amount of toner consumption per image, it is also possible to make control means 31 automatically change the cleaning efficiency based on the signals resulting from such automatic detection.

Figure 3:
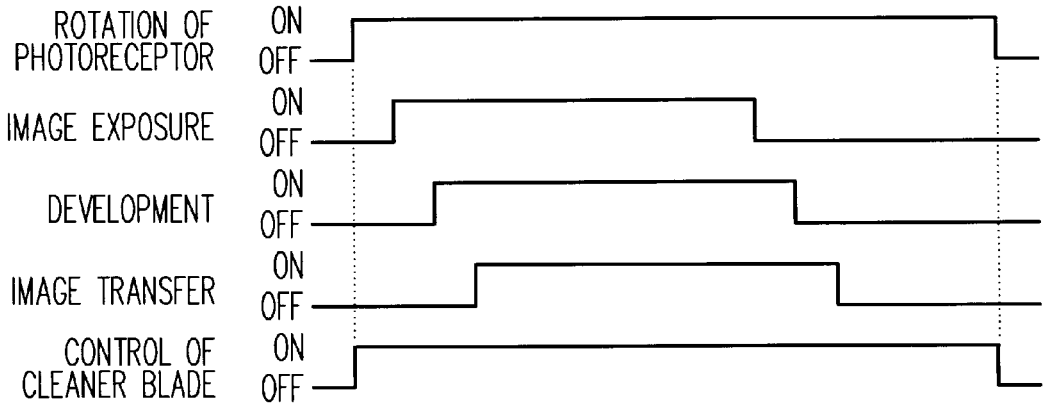
FIG. 3 is a time chart for the device shown in FIG. 1 when the cleaning efficiency during image creation is high.
Figure 4:
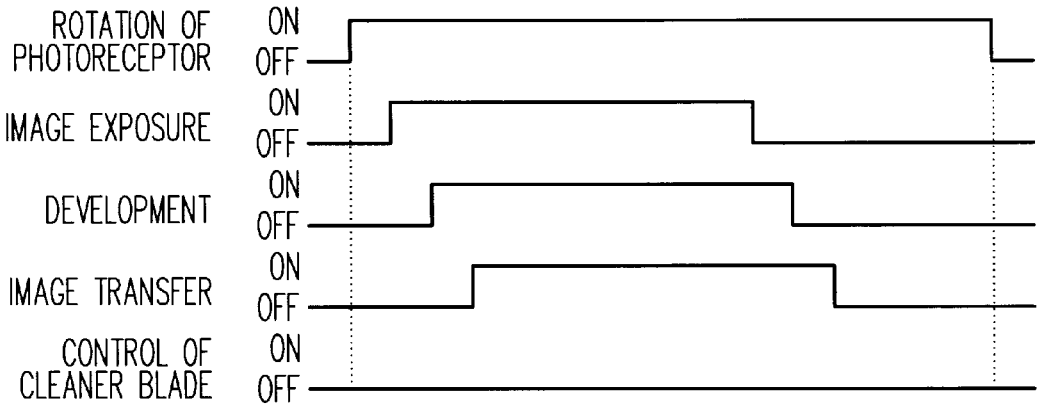
FIG. 4 is a time chart for the device shown in FIG. 1 when the cleaning efficiency during image creation is low.

FIG. 3 shows a time chart for an ON state in which cleaner blade 4 is operating (solenoid 7 is continuously OFF) relative to various other phases of image creation. FIG. 4 shows a time chart for an OFF state in which cleaner blade 4 is not operating (solenoid 7 is continuously ON) during image creation.

The image creation conditions that can be employed to determine the cleaning efficiency comprise at least one or more of the following conditions—information regarding the image creation conditions of the image forming apparatus itself, information input by the user, and information regarding the image creation conditions for the image to be formed. Cleaning efficiency may be changed in two or more steps, or where necessary, it may be changed gradually. Where two or more cleaning devices of the same type or of different types are mounted, the cleaning efficiency may be changed depending on which of them will be operated or on which combination of cleaning devices will be used.

The information regarding the image creation conditions of the image forming apparatus itself includes the printable number of sheets, the printing period, and the amount of developer consumed. Based on this information, control means 31 should change the cleaning efficiency with reference to a certain value that is determined based on the relationship between the wear on the image carrier and cleaning member and the reduction in image quality. For example, the cleaning efficiency may be reduced when the printable number of sheets for which the image carrier is to be used exceeds 1,000 pages, and the cleaning efficiency may be increased when the amount of developer consumed over a certain period of time is large.

The image creation condition information that is input by the user includes the desired image quality, the type of original and the number of continuously output printed sheets. For example, where the desired image quality is high, the original is a photograph, or the number of continuously output printed sheets exceeds ten, the cleaning efficiency may be increased, while it may be reduced otherwise.

The image creation condition information for the image to be formed includes the black/white ratio and character/graphics ratio. For example, where the black area accounts for 30% or more of the image, or where graphics account for 50% or more, for example, the cleaning efficiency may be increased, while it may be reduced otherwise.

Figure 5:
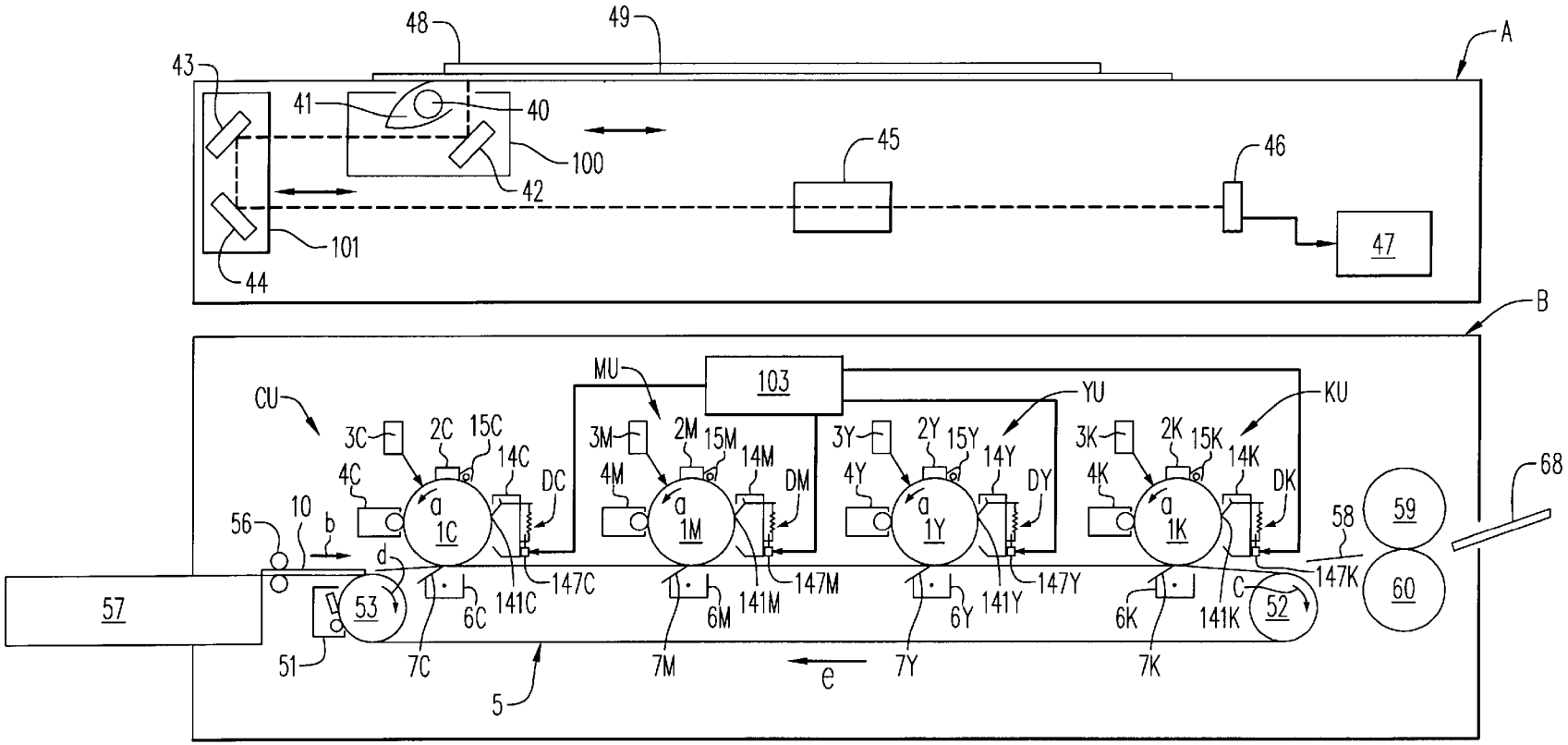
FIG. 5 shows the construction of a second embodiment of the invention, comprising a color image forming electrophotographic copying machine.

A second embodiment of the invention relates to a color image forming electrophotographic copying machine. FIG. 5 shows the construction of the color image forming apparatus, which essentially comprises image reading unit A and printer unit B that is mounted below image reading unit A. Image reading unit A reads the image of an original document and generates image signals that then undergo image processing. Printer unit B forms an image on transfer paper 10 based on the image signals for each color sent from image reading unit A. Image reading unit A includes exposure lamp 40, converging reflection mirror 41, and first moving platform 100 equipped with first mirror 42. First moving platform 100 moves parallel to platen glass 49 in order to optically scan original document 48 placed on platen glass 49.

Image reading unit A also includes second moving platform 101 equipped with second and third mirrors 43 and 44. Second moving platform 101 moves at half the speed of first moving platform 100. Image reading unit A also includes image forming lens 45, color CCD 46 and image processor 47.

The light projected by exposure lamp 40 and reflected off original document 48 is reflected by first, second and third mirrors 42, 43 and 44 and forms an image on color CCD 46 via image forming lens 45. First and second moving platforms 100 and 101 maintain a constant light path length for the scanning optical system by means of their difference in speed, for the purpose of image creation using the reflected light.

Color CCD 46 outputs image information signals for three colors, i.e., red, green and blue, to image processor 47 after performing color separation of the reflected light that strikes it. Image processor 47 converts the image information signals for the three colors into four-color image information signals, i.e., for black, yellow, magenta and cyan, and outputs these signals to printer unit B. A color image may be formed in principle by combining yellow, magenta and cyan, without black. However, when black is added during image creation, image quality increases and the consumption of yellow, magenta and cyan toners may be reduced. Therefore, the description of this embodiment is based on the situation in which color images are reproduced using the four colors, i.e., black, yellow, magenta and cyan.

Printer unit B is equipped with four image forming units CU, MU, YU and KU. These image forming units CU, MU, YU and KU respectively correspond to the four colors, cyan, magenta, yellow and black. These image forming units CU, MU, YU and KU are mounted side-by-side inside printer unit B. Under each image forming unit CU, MU, YU and KU is located a transfer medium conveyance unit comprising transfer medium conveyor belt 5 suspended over driven roller 53 and driving roller 52. Feeder cassette 57 is located on one side of printer unit B. A pair of timing rollers 56 are mounted between feeder cassette 57 and transfer medium conveyor belt 5. Transfer paper 10, or other record medium such as a transparent OHP resin sheet, is supplied in the direction of arrow b, through a pair of timing rollers 56, to transfer medium conveyor belt 5. Transfer medium conveyor belt 5 conveys transfer paper 10 to the right in the drawing by moving in the direction indicated by arrow e.

Image forming units CU, MU, YU and KU have essentially identical constructions, which correspond to the construction of the apparatus shown in FIG. 1. Therefore, their construction will be briefly explained below with reference to image forming unit CU for the color cyan.

Image forming unit CU is equipped with photoreceptor 1C. Around photoreceptor 1C are mounted charger 2C, print head 3C including a laser light source, developing unit 4C housing a cyan toner, cleaner 14C and eraser 15C, which are sequentially located along the direction of rotation of photoreceptor 1C, as indicated by arrow a. Below photoreceptor 1C is mounted transfer charger 6C via transfer medium conveyor belt 5.

In magenta, yellow and black image forming units MU, YU and KU, developing units 4M, 4Y and 4K house toner of a corresponding color. In other words, developing units 4M, 4Y and 4K house magenta toner, yellow toner and black toner, respectively.

When a color image is formed, image forming units CU, MU, YU and KU are first driven so that photoreceptors 1C, 1M, 1Y and 1K are rotated together in the direction of arrow a, whereupon photoreceptor 1C becomes uniformly charged by charger 2C and a latent image for the cyan component is formed by means of print head 3C. This latent image is developed into a toner image by the developer containing cyan toner supplied from developing unit 4C. The developed cyan image is transferred onto transfer paper 10 conveyed by means of transfer medium conveyor belt 5 by applying to transfer charger 6C a voltage having a polarity opposite from that of the toner. When this occurs, transfer paper 10 is electrostatically adsorbed to transfer medium conveyor belt 5 by transfer charger 6C as the transfer takes place.

On the other hand, while the cyan image is being transferred to transfer paper 10 as described above, a magenta toner image is formed on photoreceptor 1M in magenta image forming unit MU in the same manner as during the cyan image creation process. The magenta image is transferred to a prescribed position on transfer paper 10 by means of transfer charger 6M when transfer paper 10, on which the cyan image has been transferred, is conveyed to the magenta image transfer position by transfer medium conveyor belt 5.

A yellow toner image and black toner image are then sequentially formed on photoreceptor 1Y and photoreceptor 1K respectively in the same manner as that described above, and the yellow image and black image are transferred to the prescribed position on transfer paper 10 conveyed by transfer medium conveyor belt 5.

When the image creation process described above is completed, transfer paper 10 is conveyed further to the right by transfer medium conveyor belt 5 and separated from transfer medium conveyor belt 5 based on the curvature of driving roller 52. Transfer paper 10, thus separated, undergoes a fusing process while passing through upper fuser roller 59 and lower fuser roller 60 after passing through pre-fusing guide plate 58, and is ejected onto eject paper tray 68.

Push-up members 7C, 7M, 7Y and 7K located near transfer chargers 6C, 6M, 6Y and 6K, respectively, push up transfer medium conveyor belt 5 so that transfer paper 10 and photoreceptors 1C, 1M, 1Y and 1K will be in closer contact, particularly at the pre-transfer positions. This is done mainly to prevent the effect of pre-transfer discharge. The positioning of the toner image on photoreceptor 1C and of transfer paper 10 on transfer medium conveyor belt 5 at the transfer position is achieved by means of timing rollers 56 that supply transfer paper 10 onto transfer medium conveyor belt 5. Arrows c and d in FIG. 1 respectively indicate the directions of rotation of driven roller 53 and driving roller 52 when transfer medium conveyor belt 5 is driven in the direction of arrow e.

On the other hand, photoreceptors 1C, 1M, 1Y and 1K for which transfer has been completed are cleaned of remaining toner by means of cleaners 14C, 14M, 14Y and 14K, respectively. They are then discharged by erasers 15C, 15M, 15Y and 15K and await the next image creation process to follow. Transfer medium conveyor belt 5 from which transfer paper 10 has been separated, is cleansed of toner, etc., that is adhering to the conveyance surface by means of cleaner 51, and awaits the conveyance of the next sheet of paper 10.

In the explanation provided above, photoreceptors 1C, 1M, 1Y and 1K are organic photoconductive photoreceptors whose photoreceptive layers are susceptible to peeling due to the stress inflicted by cleaners 14C, 14M, 14Y and 14K. As a result, the charging property may decrease, causing background fog, or the sensitivity changes, changing the image density and leading to deterioration in image quality such as reduced color reproducibility. Further, when the photoreceptors are wastefully cleaned while they are not being used for image creation, due to the lack of toner supply (remaining toner), the surfaces of photoreceptors 1C, 1M, 1Y and 1K are further scraped away. Therefore, the surfaces of photoreceptors 1C, 1M, 1Y and 1K become extremely smooth, which leads to the adhesion of said surfaces to cleaner blades 141 and to the curling of cleaner blades 141. Such cleaner blades damage the surfaces of photoreceptors 1C, 1M, 1Y and 1K, causing image noise and reduction in the useful lives of photoreceptors 1C, 1M, 1Y and 1K. Since stress by means of cleaners 14C, 14M, 14Y and 14K occurs with regard to photoreceptors made of a different material or having a different construction, they are also within the scope of the present invention. Developing units 4C, 4M, 4Y and 4K may be of either the normal development or reverse development type. In the explanation of this embodiment, however, reverse development is assumed to be employed.

Developing units 4C, 4M, 4Y and 4K contain two-component developers comprising a carrier and toner. As one embodiment, the carrier is charged to have a positive polarity and the toner is charged to have a negative polarity. The carrier is made by mixing ferrite coated with an acrylic resin coating or resin with magnetic powder. In a particular example of this embodiment, particles having an average diameter of approximately 50 microns were used. The toner is made by mixing a polyester resin or styrene acrylic resin with a pigment. For the purpose of this embodiment, particles having an average diameter of approximately 6 to 8 microns were used. For the post-processing agent, silica oxide, titanium oxide, alumina oxide and strontium titanate were used. For the developing bias, an alternating current overlaid on a DC voltage was used. For the alternating current, sine waves having a 1 KV maximum amplitude (Vp-p) and a 1 KHz frequency were used. The distances between the developing sleeves and photoreceptors 1C, 1M, 1Y and 1K were set to be 0.5 mm.

The image forming apparatus of this embodiment has multiple image creation conditions in which image forming units CU, MU, YU and KU are selected in various combinations and is capable of a composite color mode in which a color image is formed using multiple colors that may be overlaid upon one another, a monochrome mode in which an image of a single color is formed, and a simul-color mode in which a simul-color image using different colors for different areas of transfer paper 10 is formed, for example. It is also possible for the image forming apparatus to form images in a mode different from those described above by selectively using image forming units CU, MU, YU and KU in various combinations.

A color image is formed using all of image forming units CU, MU, YU and KU as described above. However, an image of a single color is formed using only one of the image forming units CU, MU, YU and KU that corresponds to the selected color.

In the case of a so-called simul-color image, in which a required number of colors are used in different areas along the direction of conveyance of transfer paper 10, for example, the number of colors selected can be two or more and therefore two, three or four of the image forming units CU, MU, YU and KU are used for image creation.

Therefore, while photoreceptors 1C, 1M, 1Y and 1K of image forming units CU, MU, YU and KU, respectively, are rotated in synchronization at all times, some of them are not used for image creation, depending on the current image creation condition. In image forming units CU, MU, YU or KU that are not used for image creation, photoreceptors 1C, 1M, 1Y or 1K are wastefully cleaned by cleaners 14C, 14M, 14Y or 14K. This is true not only with a construction in which cleaner blades 141C, 141M, 141Y and 141K are used, as in the embodiment shown in FIG. 5, but also with other constructions in which various different cleaning means, such as cleaning rollers, cleaning brushes or magnetic brush rollers, are used. All of these types of cleaning means are within the general scope of the present invention.

Figure 6:
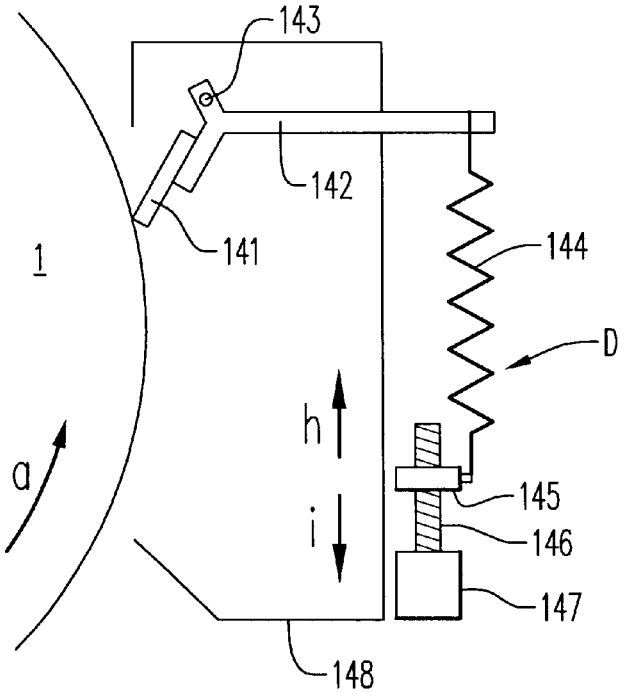
FIG. 6 is a cross-sectional view showing an alternate embodiment of the cleaner apparatus shown in FIG. 1.

FIG. 6 shows an alternative embodiment of the cleaning means of the present invention, which can be used for the cleaners 14C, 14M, 14Y and 14K using cleaner blades 141C, 141M, 141Y and 141K, respectively. Since cleaners 14C, 14M, 14Y and 14K share the same construction, the symbols that indicate cyan, magenta, yellow and black (C, M, Y, K) are omitted from the elements in the drawing. The cleaner is equipped with cleaner housing 148, which has in its interior cleaner blade 141, support metal plate 148 that supports cleaner blade 141, and fulcrum shaft 143 that rotatably supports the support metal plate. Outside cleaner housing 148 are mounted blade pressuring spring 144, moving member 145 that is connected to the lower end of blade pressuring spring 144, screw 146 that is screwed into moving member 145, and motor 147 that is fixed to cleaner housing 148 and drives screw 146 to rotate. One end of support metal plate 142 is connected to the upper end of blade pressuring spring 144, such that the tip of cleaner blade 141 comes into contact with photoreceptor 1 by means of the spring force of blade pressuring spring 144. Cleaner blade 141 cleans the remaining toner (not shown in the drawing) on photoreceptor 1 as photoreceptor 1 rotates in the direction of arrow a.

Motor 147 turns forward or backward or stops screw 146 based on a drive signal input from an external control source. Moving member 145 moves in the direction of arrow h based on the forward rotation of screw 146. This reduces the distance between the ends of blade pressuring spring 144 so that the contact pressure of cleaner blade 141 against photoreceptor 1 is reduced. Conversely, moving member 145 moves in the direction of arrow i based on the backward rotation of screw 146. This increases the distance between the ends of blade pressuring spring 144 so that the contact pressure of cleaner blade 141 against photoreceptor 1 increases. In other words, based on the forward or backward rotation or cessation of motor 147, screw 146 turns forward or backward or stops, which in turn moves up or down or stops moving member 145 to change the contact pressure of cleaner blade 141 against photoreceptor 1.

In the image forming units CU, MU, YU and KU mounted in the color image forming apparatus shown in FIG. 5, the forward and backward rotation and cessation of motors 147C, 147M, 147Y and 147K are controlled by means of control unit 103 in response to the selected image creation condition.

As in the first embodiment, the control unit 103 can be implemented in the microcomputer that controls the operation of the entire image forming apparatus. It is also acceptable if control unit 103 comprises one of various kinds of dedicated control circuits or devices, or of those that are shared for other operational controls.

When a 'mono-color image' is selected ('black image' for the purpose of explanation here), control unit 103 sends to cleaners 14C, 14M and 14Y of image forming units CU, MU and YU, which will not participate in image creation, drive signals that will rotate motors 147C, 147M and 147Y forward to move moving members 145C, 145M and 145Y upward to prescribed positions. Consequently, the contact pressure against photoreceptors 1C, 1M and 1Y, of cleaner blades 141C, 141M and 141Y of these unused image forming units CU, MU and YU decreases.

Subsequently, creation of a black image by image forming unit KU begins. When this occurs, photoreceptors 1C, 1M and 1Y of image forming units CU, MU and YU form latent images that correspond to a 'blank sheet'. In other words, these image forming units CU, MU and YU do not carry out exposure by means of printer heads 3C, 3M and 3Y. It does not matter whether or not developing units 4C, 4M and 4Y are operated. If they are operated, they should be operated as if to develop a 'blank sheet'. More preferably, to avoid unnecessary deterioration of the developer, the operation of the developing units may be stopped. Since the contact pressure of cleaner blades 141 against photoreceptors 1C, 1M and 1Y is reduced, the scraping and the stress inflicted to the photoreceptive layers due to the wasteful cleaning of photoreceptors 1C, 1M and 1Y by means of the cleaner blades decrease, such that the curling of the cleaner blades as well as damage to the photoreceptors and image noise caused by such may be prevented. Therefore, the image may be kept stable over a longer period of time. In addition, the useful lives of photoreceptors 1C, 1M and 1Y are not unnecessarily reduced.

In one example of the embodiment, the maximum contact pressure of cleaner blades 141 was set to be 3 g/mm. If the contact pressure exceeds 3 g/mm, the likelihood increases that curling of the cleaner blades will occur and the photoreceptive layers of photoreceptors 1C, 1M, 1Y and 1K will be additionally scraped away, further damaging the photoreceptors. The minimum contact pressure is 0.5 g/mm. When this level was not met, cleaner blades 141 and photoreceptors 1C, 1M, 1Y and 1K partially lost contact, and internal contamination due to scattered toner particles occurred in the areas from the cleaner blades 141 to erasers 15C, 15M, 15Y and 15K and to chargers 2C, 2M, 2Y and 2K. Therefore, the maximum pressure variation ratio was set at 6 (3 g/mm:0.5 g/mm). This ratio is used during monochrome mode when it is not particularly necessary to consider erroneous overlapping of images. During simul-color mode or color mode, if the pressure variation is large, the photoreceptor driving torque changes and toner images formed on photoreceptors 1C, 1M, 1Y or 1K cannot be accurately transferred to the prescribed position on transfer paper 10, which may lead to erroneous overlapping of images. Therefore, the variation ratio for the contact pressure is set at 1.2, so that no erroneous overlapping of images will take place.

In this explanation, variation in the contact pressure during monochrome mode, simul-color mode and color mode, which are the selectable image creation conditions, was described, but the present invention may be used for control regarding the areas of the photoreceptor between images, setting of a cleaning parameter for each unit based on differences in remaining toner, control based on elapsed time, control based on temperature or humidity, and control during regular copying and after a fault condition. In addition, while a transfer medium conveyor belt was used in the apparatus explained above, the present invention may also be used in a construction in which an intermediate transfer unit is used.

In the foregoing description, motor 147, screw 146 and moving member 145 were used in connection with the changing of the contact pressure of cleaner blade 141, but the method of changing this pressure is not limited to such an approach. Any method is acceptable as long as the contact pressure is changed, including a method in which a solenoid is used in place of motor 147 and screw 146, a method in which the pressure is changed via rotation of a cam, etc. linked to blade pressuring spring 144, and a method in which the pressure is changed directly by a solenoid, etc. without the use of a spring.

As explained above, using the present invention, where high quality images without background fog caused by remaining toner are required, or where it is necessary to prevent foreign matter from adhering to the surface of the image carrier or to remove foreign matter from the surface of the image carrier, a cleaning parameter is varied to increase the cleaning efficiency. On the other hand, where high quality images are not particularly necessary, or where it is desirable to reduce unnecessary wear on the image carrier and cleaning member, the cleaning efficiency parameter is reduced. Because the setting of the cleaning member is changed in this way, the image carrier and cleaning member may be used for a long time without causing undue wear on the image carrier or cleaning member, and without obtaining smudged images caused by remaining toner or toner adhering to the image carrier.

The cleaning parameter that is changed on the basis of the selected image creation condition is not limited to the contact pressure. It may be the applied pressure, the degree of contact or the number of rotations, which may be set to various levels in response to the type of the cleaning means. In addition, the explanation of the invention assumed a copying machine as an example, but the present invention is not limited to this. It may be used in any other electrophotographic image forming apparatus in which similar problems occur, such as a printer or facsimile machine, or in another type of image forming apparatus that does not use the electrophotographic process.

What is claimed is:

1. An image forming apparatus comprising:

a plurality of image forming units having a plurality of selectable operational conditions, each including:
- an image carrier which carries an image thereon;
- a transferring device which transfers the image on the image carrier to a recording sheet; and
- a cleaning device which cleans the image carrier after the transfer of the image; and altering means for changing cleaning efficiency of the cleaning device of one of the image forming units which is not dedicated to the formation of an image that is currently being formed.

2. The image forming apparatus of claim 1, further comprising:

an operation panel for manually selecting one of said operational conditions.

3. The image forming apparatus of claim 1, wherein said cleaning device is in pressure contact with said image carrier, and wherein said altering means changes the contact pressure.

4. The image forming apparatus of claim 3, wherein the ratio of the pressure is varied in a range from 1:1.2 to 1:6 by said altering means.

5. The image forming apparatus of claim 1, wherein said selectable operational conditions include the quality of images to be formed.

6. The image forming apparatus of claim 1, wherein said selectable operational conditions include whether an image to be formed is a monochrome or multi-color image.

7. The image forming apparatus of claim 1, wherein some of said image forming units are used in at least one of said selectable operational conditions and are not used in at least one other selectable operational condition, and said altering means reduces the cleaning efficiency of an image forming unit which is not used during an operational condition.

8. The image forming unit of claim 7, wherein the cleaning device of each image forming unit is in pressure contact with its respective image carrier, and said altering device maintains the cleaning device in contact with the image carrier during the operational conditions in which the image forming unit is not used.

9. The image forming apparatus of claim 1, wherein the respective image carriers of said plural image forming units move in synchronism in each of said selectable operational conditions.

10. An image forming apparatus comprising:

a plurality of image forming units having a plurality of selectable operational conditions, each including:
- an image carrier which carries an image thereon;
- a transferring device which transfers the image on the image carrier to a recording sheet; and
- a cleaning device which cleans the image carrier after the transfer of the image; and altering means for changing cleaning efficiency of said cleaning devices in accordance with a selected operational condition of said image forming apparatus by altering the pressure with which the cleaning device of each image forming unit contacts its respective image carrier, and wherein the ratio of contact pressure between said image forming units is varied in a range from 1:1.2 to 1:6 by said altering means.

11. An image forming apparatus comprising:

an image forming unit having a plurality of selectable operational conditions, and including:
- an image carrier which carries an image thereon;
- a transferring device which transfers the image on the image carrier to a recording sheet; and
- a cleaning device which cleans the image carrier after the transfer of the image; and altering means for changing cleaning efficiency of said cleaning device in accordance with a selected operational condition of said image forming apparatus, wherein said selectable operational conditions include the number of continuously output printed sheets.

12. An image forming apparatus comprising:

an image forming unit that can selectably form a composite color image or a simul-color image, and including:
- an image carrier which carries an image thereon;
- a transferring device which transfers the image on the image carrier to a recording sheet; and
- a cleaning device which cleans the image carrier after the transfer of the image; and altering means for changing cleaning efficiency of the cleaning device in accordance with whether an image to be formed is a composite color image or a simul-color image.

13. An image forming apparatus comprising:

a plurality of image forming units having a plurality of image forming conditions, each including:
- an image carrier which carries an image thereon;
- a transferring device which transfers the image on the image carrier to a recording sheet; and
- a cleaning device which cleans the image carrier after the transfer of the image; and altering means for changing cleaning efficiency of the cleaning device of one of the image forming units which is not dedicated to the formation of an image that is currently being formed.

14. The image forming apparatus of claim 13, further comprising:

an operation panel for manually selecting one of said image forming conditions.

15. The image forming apparatus of claim 13, wherein said cleaning device is in pressure contact with said image carrier, and wherein said altering means changes the contact pressure.

16. The image forming apparatus of claim 13, wherein said plurality of image forming conditions respectively relate to different qualities of images to be formed.

17. The image forming apparatus of claim 13, wherein said plurality of image forming conditions respectively relate to different amounts of developer consumed in the formation of an image.

18. The image forming apparatus of claim 13, wherein said plurality of image forming conditions respectively relate to the ratio of black to white in an image to be formed.

19. The image forming apparatus of claim 13, wherein said plurality of image forming conditions respectively relate to the ratio of characters to graphics in an image to be formed.

20. The image forming apparatus of claim 13, wherein said plurality of image forming conditions respectively relate to whether a monochrome or multi-color image is to be formed.

21. The image forming apparatus of claim 13, wherein some of said image forming units are used in at least one of said image forming conditions and are not used in at least one other image forming condition, and said altering means reduces the cleaning efficiency of an image forming unit which is not used during an image forming condition.

22. The image forming unit of claim 21, wherein the cleaning device of each image forming unit is in pressure contact with its respective image carrier, and said altering device maintains the cleaning device in contact with the image carrier during the image forming conditions in which the image forming unit is not used.

23. The image forming apparatus of claim 13, wherein the respective image carriers of said plural image forming units move in synchronism in each of said selectable operational conditions.

24. A color image forming apparatus having multiple image forming units, that operate under different image forming conditions in which said image forming units are selected in various combinations, wherein said image forming units each comprise an image carrier, a charging means that charges said image carrier, an exposure means that forms a latent image on the charged image carrier, a developing means that develops the latent image on said image carrier into a toner image, a transfer means that transfers to a transfer medium the toner image, a cleaning means that cleans any remaining matter on said image carrier after said transfer is performed, a cleaning parameter changing means that changes a cleaning parameter that governs the operation of said cleaning means, and a controller for actuating the cleaning parameter changing means of the image forming units that are not used for image creation in response to the selected image forming condition.

25. The image forming apparatus of claim 24, wherein some of said image forming units are used in at least one of said image forming conditions and are not used in at least one other image forming condition, and said altering means reduces the cleaning efficiency of an image forming unit which is not used during an image forming condition.

26. The image forming unit of claim 25, wherein the cleaning device of each image forming unit is in pressure contact with its respective image carrier, and said altering device maintains the cleaning device in contact with the image carrier during the image forming conditions in which the image forming unit is not used.

27. The image forming apparatus of claim 24, wherein the respective image carriers of said plural image forming units move in synchronism in each of said selectable operational conditions.

28. A color image forming apparatus having multiple image forming units, that operate under different image forming conditions in which said image forming units are selected in various combinations, wherein said image forming units each comprise an image carrier, a charging means that charges said image carrier, an exposure means that forms a latent image on the charged image carrier, a developing means that develops the latent image on said image carrier into a toner image, a transfer means that transfers to a transfer medium the toner image, a cleaning means that cleans any remaining matter on said image carrier after said transfer is performed, a cleaning parameter changing means that changes contact pressure, and a controller for actuating the cleaning parameter changing means of the image forming units that are not used for image creation in response to the selected image forming condition such that the ratio of the contact pressure when an image forming unit is being operated to the contact pressure when said unit is not being operated is varied by said parameter changing means in a range from 1.2 to 6.

29. An image forming apparatus comprising:

an image forming unit having a plurality of selectable operational conditions relating to the quality of images to be formed, and including:

an image carrier which carries an image thereon;

a transferring device which transfers the image on the image carrier to a recording sheet; and a cleaning device which cleans the image carrier after the transfer of the image; and altering means for changing cleaning efficiency of the cleaning device in accordance with a selected quality of images to be formed.

30. The image forming apparatus of claim 29, further comprising:

an operation panel for manually selecting the quality of the image to be formed.

31. The image forming apparatus of claim 29, wherein said cleaning device is in pressure contact with said image carrier, and wherein said altering means changes the contact pressure.

32. The image forming apparatus of claim 31, wherein the ratio of the pressure is varied in a range from 1:1.2 to 1:6 by said altering means.

33. An image forming apparatus comprising:

an image forming unit which can selectably form different numbers of images, and including:

an image carrier which carries an image thereon;

a transferring device which transfers the image on the image carrier to a recording sheet; and a cleaning device which cleans the image carrier after the transfer of the image; and altering means for changing cleaning efficiency of the cleaning device in dependence upon the number of images to be formed.

34. The image forming apparatus of claim 33, wherein said cleaning device is in pressure contact with said image carrier, and wherein said altering means changes the contact pressure.

35. The image forming apparatus of claim 34, wherein the ratio of the pressure is varied in a range from 1:1.2 to 1:6 by said altering means.

36. An image forming apparatus comprising:

an image forming unit having a plurality of image forming conditions that respectively relate to different qualities of images to be formed, and including:

an image carrier which carries an image thereon;

a transferring device which transfers the image on the image carrier to a recording sheet; and a cleaning device which cleans the image carrier after the transfer of the image; and altering means for changing cleaning efficiency of the cleaning device in accordance with the quality of an image to be formed.

37. The image forming apparatus of claim 36, further comprising:

an operation panel for manually selecting the quality of an image to be formed.

38. The image forming apparatus of claim 36, wherein said cleaning device is in pressure contact with said image carrier, and wherein said altering means changes the contact pressure.

* * * * *